United States Patent [19]

Hennebutte

[11] Patent Number: 4,750,448

[45] Date of Patent: Jun. 14, 1988

[54] SEMI-RIGID PNEUMATIC BOAT

[75] Inventor: Georges B. L. Hennebutte, Biarritz, France

[73] Assignee: Societe d'Exploitation et Developpement des Brevets Georges Hennebutte (S.E.D.B.G.H.), France

[21] Appl. No.: 947,103

[22] Filed: Dec. 29, 1986

[30] Foreign Application Priority Data

Jan. 3, 1986 [FR] France ..... 86 00044

[51] Int. Cl.[4] ..... B63B 7/00

[52] U.S. Cl. ..... 114/345; 441/40

[58] Field of Search ..... 114/344, 345; 441/40–42

[56] References Cited

U.S. PATENT DOCUMENTS 3,261,038 7/1966 Klepper ..... 114/345

3,416,171 12/1968 Hennebutte ..... 114/345

FOREIGN PATENT DOCUMENTS 1313850 4/1973 United Kingdom ..... 114/345

*Primary Examiner*—Sherman D. Basinger

*Assistant Examiner*—Jesûs D. Sotelo

*Attorney, Agent, or Firm*—Murray Schaffer

[57] ABSTRACT

A hull is provided with two pneumatic side stabilizers jointed pointwise at the front and housed in longitudinal concavities formed on the side of the hull. Each stabilizer is received at its front end in a tapering cover formed at the prow of the boat and is removable in order to be stored in the inflated state inside the boat, thereby reducing the width of the boat for road transport.

17 Claims, 3 Drawing Sheets

SEMI-RIGID PNEUMATIC BOAT

BACKGROUND OF THE INVENTION

The present invention relates to a semi-rigid pneumatic boats or dinghies and, in particular, to boats comprising a rigid hull carrying on both its sides a pneumatic float or stabilizer.

The present trend is to manufacture boats of this type so that each successive model has an incresed length. The result is that the width of the longer boats must be also be increased. Consequently, at a certain length the width of the boat, equipped with its inflated side stabilizers, exceeds the predetermined limit value within which the boat may be transported on public highways.

In order to overcome this difficulty, it has been proposed to provide for the deflation of the stabilizers so that they may be laid against the hull, thereby allowing the boat to reach at most the limit in width. This solution, on the one hand, leaves the stabilizers exposed to sideways impact and, on the other hand, necessitates periodic deflating and reinflating the stabilizers.

The object of the present invention is to remedy these disadvantages by providing a boat of the type mentioned which, when equipped with its stabilizers, exceeds the authozied limit and which, withoout its stabilizers being deflated, can be transported on highways without problems.

SUMMARY OF THE INVENTION

To this effect, the semi-rigid pneumatic boat according to the invention includes a rigid hull provided with two side pneumatic stabilizers jointed pointwise at the front and housed in longitudinal recesses formed on the upper outer surface of the hull. Each stabilizer is received with its front portion in a tapering cover and is totally removable in order to be stored in the inflated state inside the boat, thereby reducing the width of the boat during road transport.

The cover may be made, for example, of a flexible cloth or of a rigid material integral with the hull.

The front portion of each stabilizer is maintained in its cover by removable fastening means, preferably resilient holders, acting between the cover and the stabilizer.

Moreover, each stabilizer is maintained against the hull by at least another fastening device, preferably at the level of the flat stern board.

In the stored position within the boat each stabilizer is wedged laterally against a hull side, and its front portion is inserted inside the frontpoint or prow. Means are provided for maintaining each stabilizer in the stored position.

Each stabilizer can be made of a single member or, on the other hand, by at least two individual pneumatic elements assembled end to end in a separable manner.

The invention will be better understood from the reading of the following description, with reference to the accompanying drawings.

DESCRIPTION OF THE INVENTION

Figure 2:
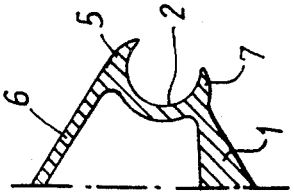
FIG. 2 is a sectional view of the starboard half of the boat along line II—II of FIG. 1, the port half being identically constructed.
Figure 1:
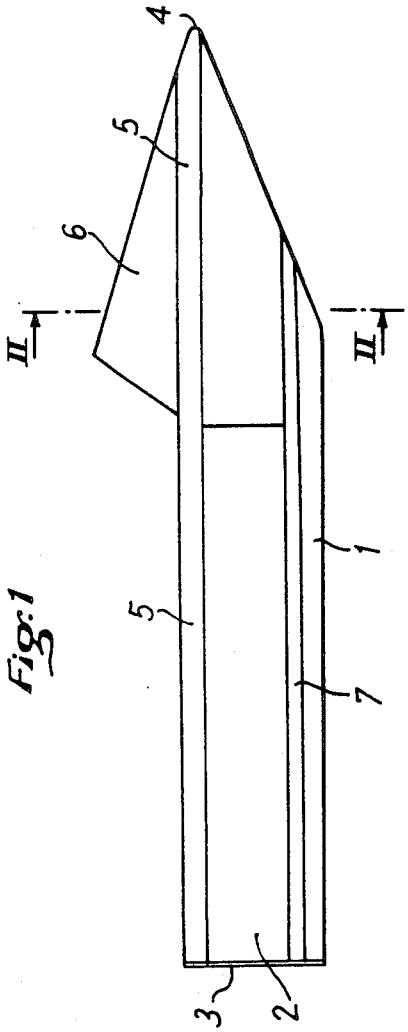
FIG. 1 is a side elevational view of the hull of a boat embodying the present invention.

In FIGS. 1 and 2 the rigid general V-shaped hull of a semi-rigid pneumatic boat or dinghy according to the invention is shown. On both side of the hull 1 there is formed a longitudinal groove 2 extending from the rear stern board 3 to the front tapering prow 4.

The groove 2 is generally cylindrical being formed with an upper lip 5 which, in its forward section, is a substantially transverse prolongation of the inclined wall forming a front hood or cowl 6. The groove 2 is completed by an opposite lower lip 7 which is substantially the transverse prolongation of the hull bottom 1. Lips 5 and 7 extend over the entire length of the boat, lip 7 being, however, transversally shorter than lip 5.

Figure 5:
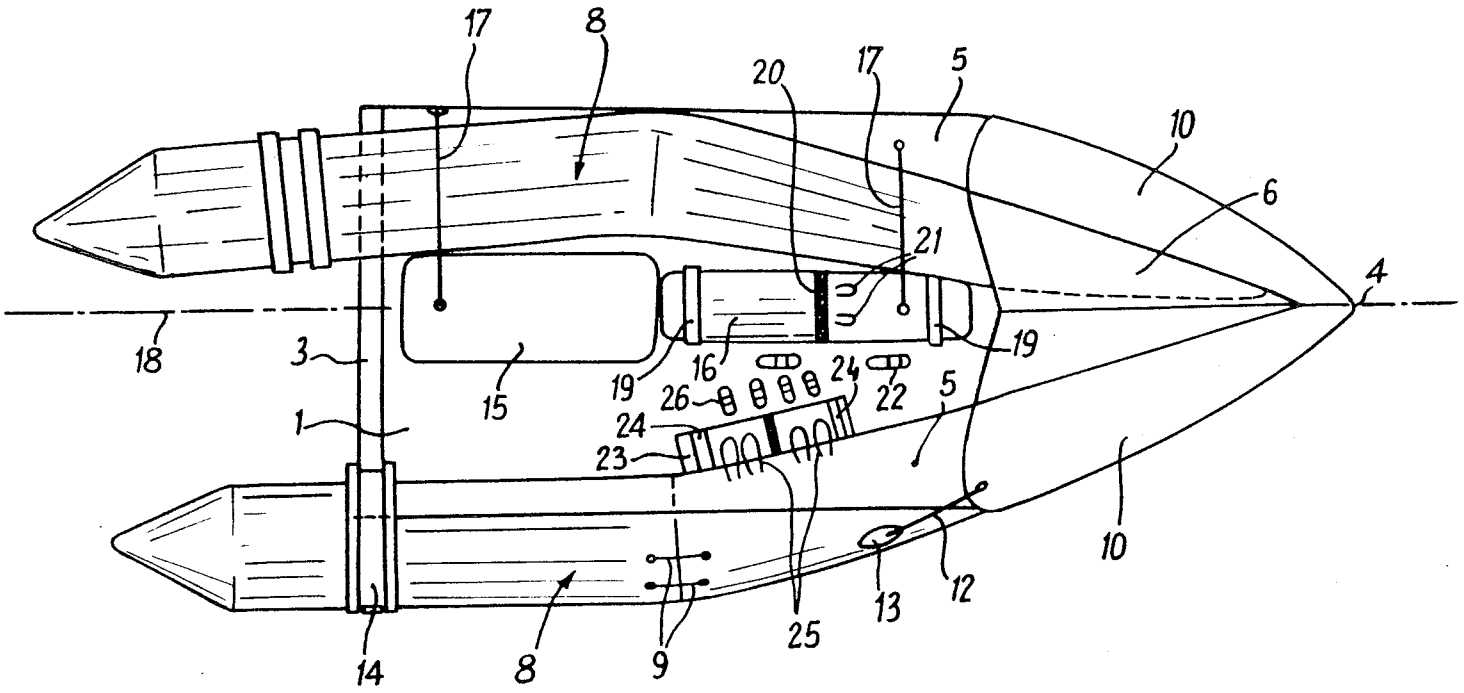
FIG. 5 is a plan view showing in the lower half the boat in a position of use and in the upper half the boat in its transport position.

Each side groove 2 is adapted to receive a float or pneumatic stabilizer 8 which can be made of a single member or of at least two inflatable elements assembled end to end in a separable manner, as shown at 9 in the lower portion of FIG. 5. Preferably, the stabilizers 8 have a cross-section, increasing rearwardly by following the outline of the boat and have front and rear tapering ends. The two stabilizers 8 each define a body section and a front end section jointed, i.e. at an angle to each other so that each front end extends toward the other to form a point at the front and are symmetrical to each other, thereby being interchangeable so as to minimize stock problems.

The stabilizers 8 are totally removable from the hull. However, in the navigation or sailing position (shown in FIGS. 3 and 4 and in the lower portion of FIG. 5), each stabilizer 8 is received at its front in a tapering cover 10 which, in conjunction with the front section of the corresponding groove 2, defines a housing of substantially conical shape.

Figure 4:
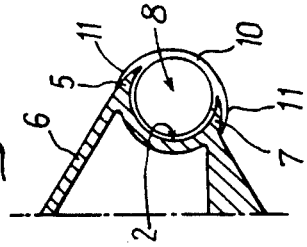
FIG. 4 is a sectional view of the starboard half of the boat taken along line IV—IV of FIG. 3, the port half being identically constructed.
Figure 3:
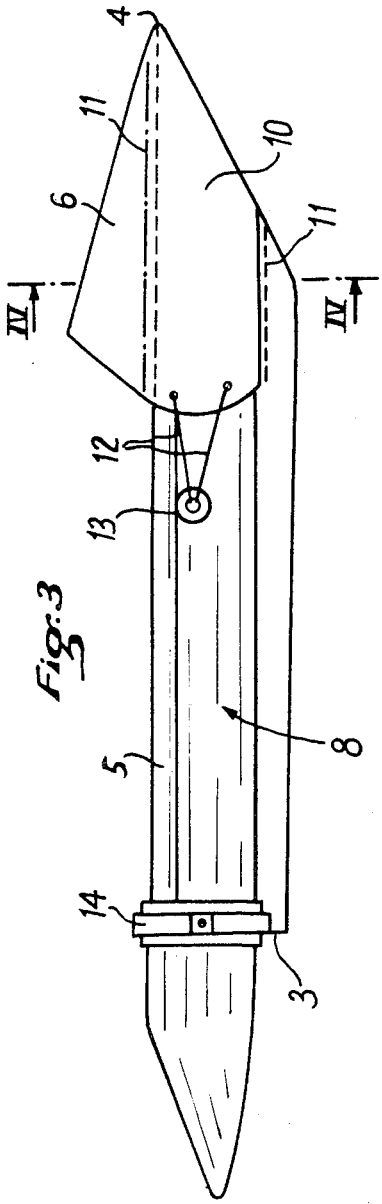
FIG. 3 is a view similar to FIG. 1 with the stabilizers in position.

The cover 10 can be made of a flexible cloth and/or of a rigid members, integral with the hull 1. In FIGS. 3 and 4 the cover 10 is fixed to the hulls by fastening means 11, and each stabilizer 8 is maintained in its cover 10 by removable fastening means such as, for example, resilient ties 12 attached to the rear portion of cover 10 and to a platen 13 rigidly connected to the stabilizer 8. Platen 13 is situated rearwardly of cover 10 so that ties 12 bias each stabilizer frontwardly with a tendency to cause the float to remain inserted in the cover.

Each stabilizer 8 is moreover maintained against the hull 1 by at least another fastening device, particularly a strap 14 as shown, at the flat stern board 3, thereby holding the stabilizer 8 to the hull.

Figure 8:
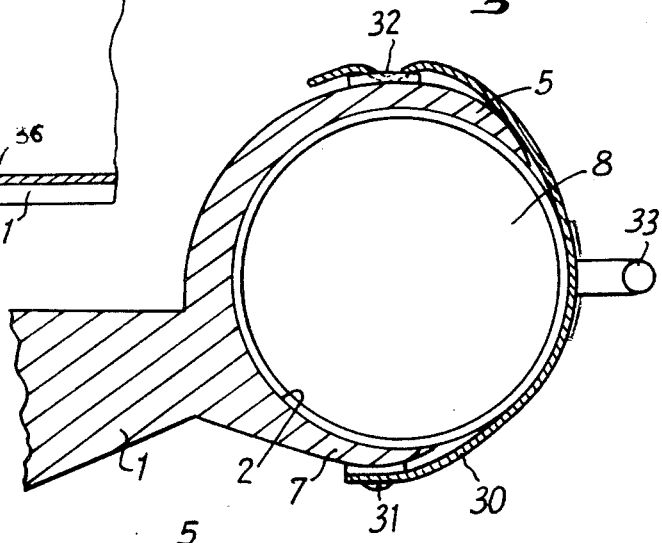
FIG. 8 is a transverse sectional view at a larger scale along line VIII—VIII of FIG. 9, showing the float maintaining means and the carrying means.
Figure 9:
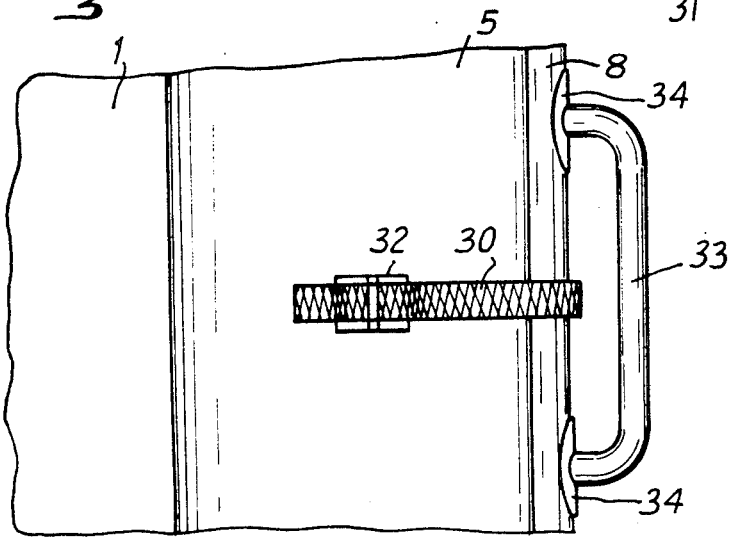
FIG. 9 is a top plan view of FIG. 8.

As shown in FIGS. 8 and 9 a strap 30 is attached to a fitting 31, rigidly connected to the outer lower face of lip 7 to urge the stabilizer into groove 2. The strap 30 is secured at its opposite end against motion by buckle 32 or is similarly rigidly connected to the other upper face of upper lip 5. The strap 30 extends through a U-shaped carrying handle 33, which is fixed at half the height of the stabilizer 8 by platens 34, which are for example glued to the surface of the stabilizer.

The fastening means 14 and 30 act as shown in FIGS. 3 and 4 and in the lower portion of FIG. 5 to hold the inflated stabilizers, thus immobilized and fixed outside the hull so that the boat can be easily navigated while enabling the stabilizers to be easily released and extracted from covers 10 and shifted into the boat for land travel. The front ends of the stabilizers 8 are placed underneath the cowl 6 and wedged, for example, between the corresponding side of the boat and the drive motor 15 or bench 16. Fastening means can be provided for maintaining each stabilizer 8 in this storage position, such means being, for example, shown by ties 17 extending between the corresponding boat side and the motor 15 and/or bench 16. In this stored condition the boat is more easily transported over the road.

In the stored position each stabilizer 8 does not substantially exceed, in length, the central longitudinal axis 18 of the boat, so that both stablizers can be stored simultaneously in the inflated state in the boat.

From the foregoing, it follows that, in the boat according to the invention, the side stabilizers can be easily separated from the hull and stored in the inflated state in the boat itself and the boat width reduced to less than the authorized value permitted for road transport.

A particular arrangement of a bench 16 is shown in FIG. 5. The bench 16 is made of a pneumatic cylinder inflated at a low pressure and connected to the hull bottom by straps 19 and at least one stretched resilient intermediate strap 20. The bench 16 carries on its upper surface handles 21 which the members of the crew can grip during sailing. The boat bottom is provided on both sides of bench 16 with toe-clips 22 in the form of babouches.

To provide for passengers, the boat can also include along both sides benches 23, possibly removable, similar to bench 16. The benches 23 are maintained by straps 24. Shoulder harnesses 25 are attached to the hull and/or stabilizers in association with the benches 23 so that the passagers can be safely restrained. The benches 23 are also associated with toe-clips 26 similar to toe-clips 22. To facilitate placement of the stabilizers for land transport in the manner shown in the upper half of FIG. 5, the benches 23 can be removed.

Figure 6:
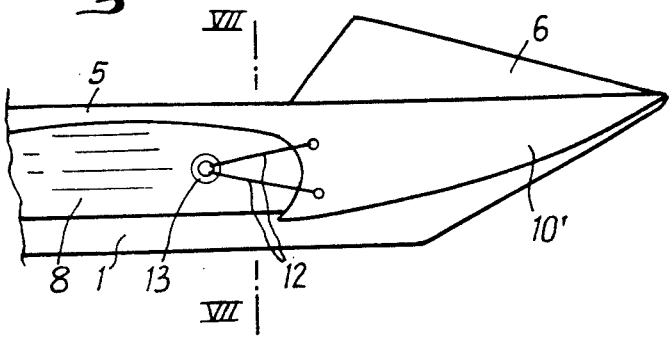
FIG. 6 is a side elevational view of the front portion of a boat, according to an alternative embodiment.
Figure 7:
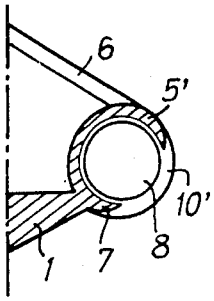
FIG. 7 is a sectional view along line VII—VII of FIG. 6.

In the embodiment of FIGS. 1 to 5, cover 10 is separate from hull 1. In the alternative embodiment shown in FIGS. 6 and 7, a cover 10' is provided which is integral with hull 1 and, therefore, with lips 5' and 7. The lower lip 7 is identical to that shown in FIGS. 1 to 5, while upper lip 5' is widening transversely in the forward direction up to its connection with cover 10' so as to surround more intimately the stabilizer 8 so as to better hold the stabilizer 8 and prevent water from seeping between the groove 2 and the stabilizer 8.

Figure 10:
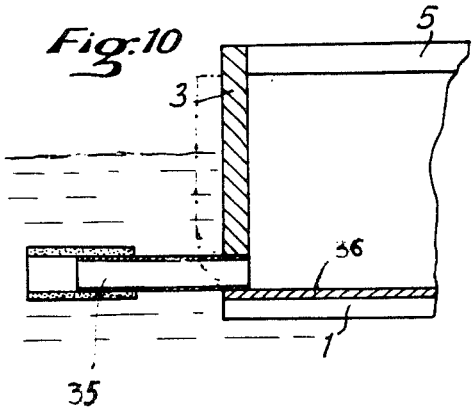
FIG. 10 is an elongated view of the rear of the boat partially in section.

FIG. 10 schematically shows in longitudinal cross-section the stern of the boat having a flexible tube 35 passing through the stern board 3 and having its end flush with the inner face of the stern board 3. The tube 35 normally projects rearwardly from the stern board 3 by about 30 to 40 cm and has a diameter up to about 20 cm. The tube 35 is located just at the level of the floor 36 of hull 1 and is adapted to have buoyant properties as, for example, being formed of foamed impervious material, for example rubber or plastic, so that at stop or at low speed its inherent buoyancy allows the tube 35 (as seen in phanton lines) to lie flat by itself against the rear face of the stern board 3 with its remote end secured to the stern board 3 above the water level. Thus, water is prevented from entering the boat. At high speed the dynamic suction effect caused in the wake of the boat and possibly in combination with the thrust of water likely to be present in the boat, causes a straightening of tube 35 into the substantially horizontal position, premitting free drainage of the water from the boat, the water being drawn by the vacuum pump effect caused by the outer water.

Of course, the invention is not limited to the embodiments described and various alternative can be envisaged without departing from its scope.

What is claimed is:

1. A semi-rigid boat comprising a hull having a bottom, a pair of spaced side walls and a tapering cover at its prow, a pair of pneumatically inflated stabilizers having a tubular body along each side wall in longitudinal concavities formed on the outer faces of said side walls and being jointed pointwise at their front ends for insertion within said cover, said inflated stabilizer bodies being totally removable from said longitudinal concavities for storage within the space between said side walls with said front ends within said cover, whereby the overall width of said boat may be reduced for road transport without deflation of said stabilizers.

2. The boat according to claim 1 wherein said cover comprises a flexible cloth attached to the hull.

3. The boat according to claim 1 wherein said cover is formed of rigid, shaped material and is fixedly attached to said hull.

4. The boat according to claim 1 including first fastening means for removably securing the front ends of said stabilizer in said cover, said first fastening means comprising one or more elastic ties, each connected at one end to said cover and at its other end to said stabilizer.

5. The boat according to claim 1 including second fastening means for removably securing the body of said stabilizer withing said concavity, said second fastening means comprising a strap attached at one end to said hull below said concavity and at its other end to said hull above said concavity to girdle and press said stabilizer body into said concavity.

6. The boat according to claim 5 including a handle secured to said stabilizer through which said strap passes.

7. The boat according to claim 1 including means for maintaining each said stabilizer body in storage in a position wedged against the inface of the side wall of the hull and with the front end at the prow of said boat.

8. The boat according to claim 1 wherein each stabilizer does not substantially exceed the length of said boat along the longitudinal axis.

9. The boat according to claim 1 wherein each stabilizer comprises an integral structure.

10. The boat according to claim 1 wherein each stabilizer comprises a pair of tubular members assembled end to end in a separable manner.

11. The boat according to claim 1 including a first pneumatic bench inflated at a low pressure, attached to the bottom of said hull and having associated crew retaining means.

12. The boat according to claim 1 wherein said retaining means include handles and toe-clips.

13. The boat according to claim 1 including at least one second pneumatic bench removable secured to said hull and having associated passenger retaining means.

14. The boat according to claim 13 wherein said passenger retaining means comprises shoulder harnesses and toe-clips.

15. The boat according to claim 11 wherein said first bench is attached to the boat hull by end straps and by at least one stretched resilient intermediate strap.

16. The boat according to claim 1 wherein said stabilizers are symmetrical to each other and itnerchangeable.

17. The boat according to claim 1 wherein the stern board of said hull is provided with a flexible and impervious tube projecting rearwardly from said stern board and having bouyancy properties whereby at stop or at low speed said tube lies itself against the rear face of said stern board so that its rear end is above the water level and at high sailing speed it extends rearwardly in a substantially horizontal position to allow drainage of water present in the boat.

* * * * *